US005564225A

United States Patent [19]

Quiding et al.

[11] Patent Number: 5,564,225

[45] Date of Patent: Oct. 15, 1996

[54] METHOD AND APPARATUS FOR PACKAGING AND PRESERVATION OF FLOWERS AND OTHER BOTANICALS

[75] Inventors: Douglas C. Quiding, Custer, Wash.; Dennis H. McEachern, Concord, N.C.

[73] Assignee: Beauty Fill Development, Ltd., Kelowna, Canada

[21] Appl. No.: 420,502

[22] Filed: Apr. 12, 1995

[51] Int. Cl.[6] ..... A01C 1/00

[52] U.S. Cl. ..... 47/58; 47/1.01; 47/84; 53/432; 206/423

[58] Field of Search ..... 47/84 R, 1.01, 47/1 B, 58.12, 58.11; 206/423; 53/432

[56] References Cited

U.S. PATENT DOCUMENTS

| | | | |
|---|---|---|---|
| 1,885,879 | 11/1932 | Whittington . | |
| 2,632,286 | 3/1953 | Newhall | 47/41 |
| 2,787,818 | 4/1957 | Kaber | 24/5 |
| 3,259,236 | 7/1966 | Cole | 206/79 |
| 3,783,555 | 1/1974 | Peters | 47/38 |
| 3,842,539 | 10/1974 | Sacalis | 47/58 |
| 4,014,134 | 3/1977 | Womack, Jr. | 47/84 |
| 4,118,890 | 10/1978 | Shore | 47/28 R |
| 4,189,868 | 2/1980 | Tymchuck et al. | 47/84 |
| 4,242,835 | 1/1981 | Mondragon Sorribes | 47/84 |
| 4,515,266 | 5/1985 | Myers | 206/205 |
| 4,591,055 | 5/1986 | Corn | 206/459 |
| 4,686,790 | 8/1987 | Lahalih et al. | 47/9 |
| 4,827,663 | 5/1989 | Stern | 47/41.13 |
| 4,928,424 | 5/1990 | Campanelli | 47/1 B |
| 5,054,234 | 10/1991 | Cassells | 47/84 R |
| 5,102,715 | 4/1992 | Zetterquist | 428/137 |
| 5,103,586 | 4/1992 | Farrell | 47/41.12 |
| 5,167,672 | 12/1992 | Farrell | 47/58 |
| 5,174,794 | 12/1992 | Brownlee | 47/1 B |
| 5,203,138 | 4/1993 | Schvester et al. | 53/428 |
| 5,224,598 | 7/1993 | Angeles et al. | 206/423 |
| 5,247,746 | 9/1993 | Johnson et al. | 53/432 |
| 5,371,998 | 12/1994 | Johnson et al. | 53/432 |

*Primary Examiner*—Henry E. Raduazo
*Attorney, Agent, or Firm*—Ralph H. Dougherty; Scott E. Hanf

[57] ABSTRACT

An improved method and apparatus for packaging roses or other flowers (or other "botanicals"; e.g., cedar fronds) so that they are preserved in a fresh state for an extended period. A modified atmosphere packaging (MAP) machine seals the flower in a container under vacuum, and a vial which is attached to the stem of the flower includes a solution which releases preservative and rehydration materials from an absorbent medium so that the materials flow through the stem and outwardly through the pores of the flower and its leaves. An ion balanced environment stabilizes pollen and color while prolonging the shelf life of the cut flowers.

8 Claims, 5 Drawing Sheets

Fig.1
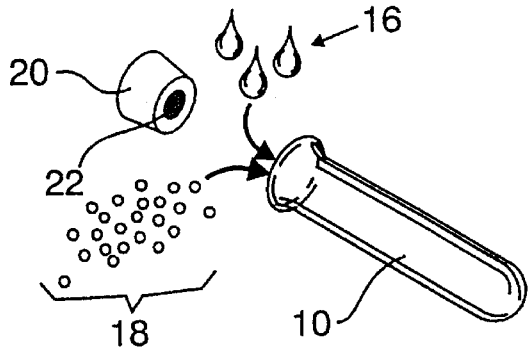
Fig.2
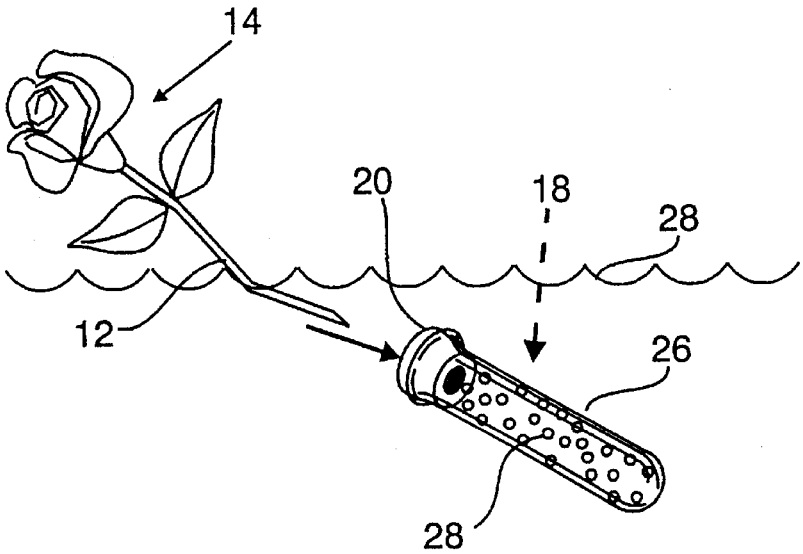
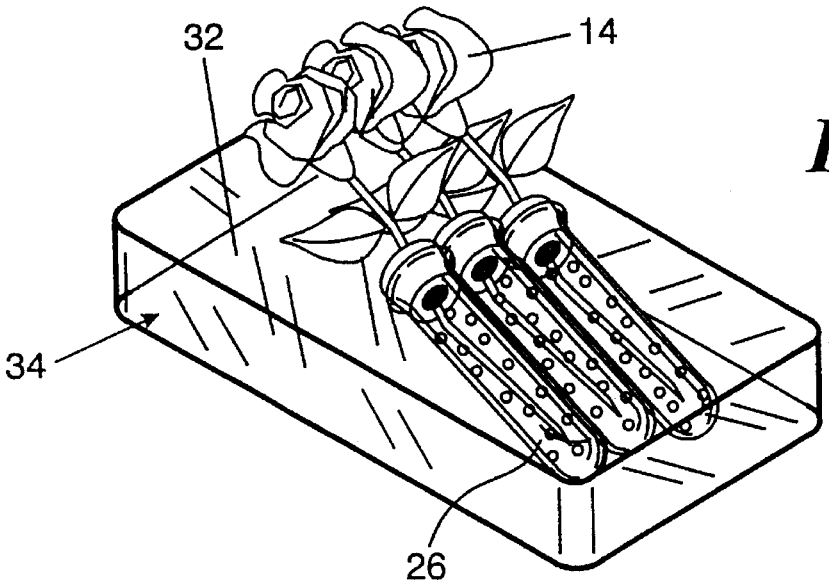
Fig.3

Fig.4
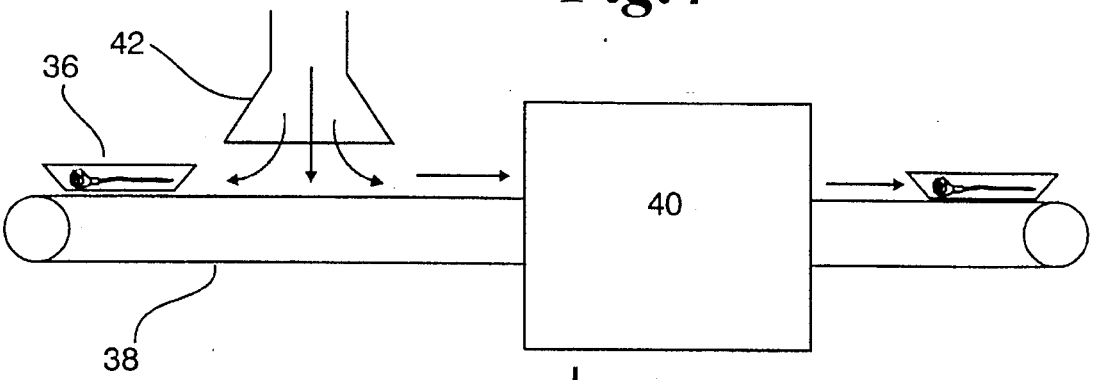
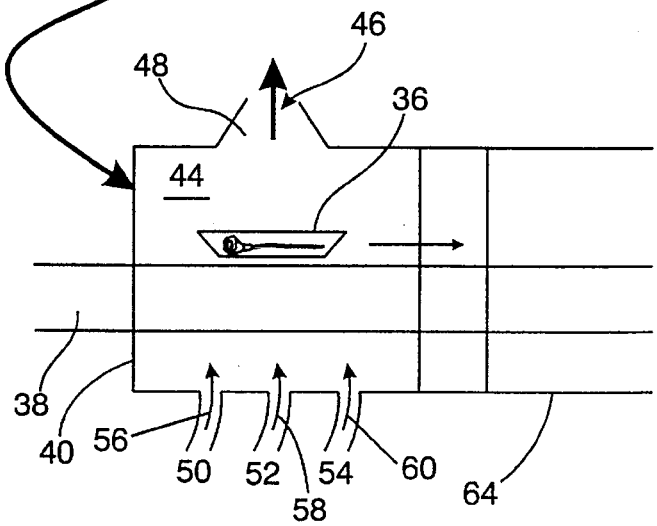
Fig.5
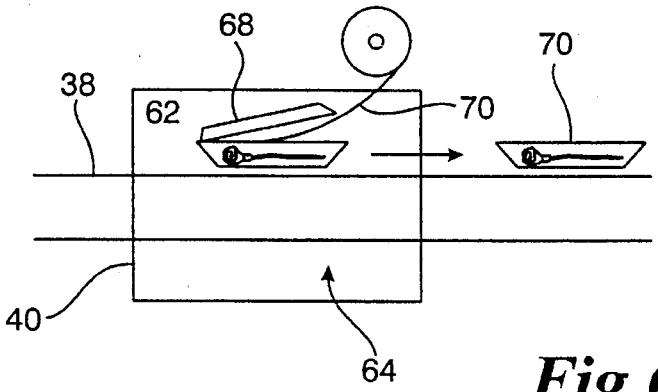
Fig.6

80
78
82
98
86
90
84
88
104
92
122
118
102
120
94
116
114
112
108
106
110
100

METHOD AND APPARATUS FOR PACKAGING AND PRESERVATION OF FLOWERS AND OTHER BOTANICALS

FIELD OF THE INVENTION

The present invention relates to a flower and other botanical packaging apparatus and a process for packaging flowers (or other "botanicals"; e.g., cedar fronds) so that they are preserved in a fresh state for an extended period using a modified atmosphere package.

BACKGROUND OF THE INVENTION

Most vegetables and fruits have relatively short shelf lives in the ripened condition while flowers do not last long after they are cut. All fresh produce respires after harvest. The largest gas component of this respiration is carbon dioxide. Significantly, ethylene is also generated by botanical respiration which has a catalytic effect on accelerating ripening rate. Ethylene also causes premature death in flowers, even when present in low levels. It is known that shelf life of perishable produce can be lengthened by preserving it in inert gas filled containers. Oxygen, the all-important life giving element, possesses the unfortunate property of supporting the growth of bacteria, which causes food deterioration and discoloration. Improvement in produce shelf life can be gained by reducing the oxygen available for conversion to carbon dioxide, reducing ethylene levels to slow catalytic effects, and maintaining a higher than atmospheric level of carbon dioxide to reduce bacteriological growth. Also, the replacement of oxygen by an inert atmosphere, such as nitrogen, argon or helium inhibits bacterial growth, assuring longer shelf life and retention of flavor and color.

Modified atmosphere containers have been mostly in the form of storage rooms and portable container vans having systems for continuously monitoring and changing the atmosphere to reduce or eliminate oxygen or other gases which affect ripening of produce.

Individual modified atmosphere containers have been tested wherein a sealed container occupied by produce is formed by a high barrier film and filled with a mixture of nitrogen and/or carbon dioxide. One difficulty experienced with such a container is that produce respiration and bacterial action causes gases and volatiles to build up inside the container, resulting in a continuing increase in pressure which eventually produces bulging and even rupture of the container.

DESCRIPTION OF THE PRIOR ART

Applicants are aware of the following U.S. Patent concerning packaging and preservation of flowers and other botanicals:

| U.S. Pat. No. | Inventor | Issue Date | Title |
|---|---|---|---|
| 4,515,266 | Myers | 05-07-1985 | MODIFIED ATMOSPHERE PACKAGE AND PROCESS |

Myers U.S. Pat. No. 4,515,266 provides a package for preserving produce in a wholesome condition for an extended period of time, which is formed by a sealed container enveloping the produce and filled with a preservative gas. This gas inhibits bacterial growth. The container is formed by a high barrier film which is perforated to provide a gas pressure within the container sufficient to inhibit air flow into the container and to assure gas outflow from the container to prevent its distortion.

SUMMARY OF THE INVENTION

The present invention relates to a process for packaging roses or other flowers (or other "botanicals"; e.g., cedar fronds) so that they are preserved in a fresh state for an extended period. The process centers on a modified atmosphere packaging (MAP) machine which seals the flower in a container under vacuum, and a vial which is attached to the stem of the flower and which releases a solution of preservative and rehydration materials from an absorbent medium so that these materials flow upwardly through the stem and outwardly through the pores of the flower and leaves. The primary function of the absorbent material which is added to the liquid in the vial is to stabilize the liquid in the vial against the shift in pH which otherwise occurs as the tissue compounds in the plant stem begin to break down. The system preferably incorporates a "Honeywell" positive ion generator.

As the stem breaks down under the present invention, it continually feeds the flower with the important nutrients, and to keep a continual supply of Aluminum or silver thiosulfate (STS). This reduces the level of ethylene gas produced by the flowers or cedar fronds.

OBJECTS OF THE INVENTION

The principal object of the present invention is to provide a method of packaging freshly cut flowers so that they are preserved in a fresh state for an extended period.

A further object of this invention is to provide an apparatus which packages freshly cut flowers in a ion balanced modified atmosphere.

Another object of the invention is to provide a method and apparatus which will reduce or eliminate the production of ethylene gas from the flowers and/or foliage for an extended period of time.

BRIEF DESCRIPTION OF THE DRAWINGS

The foregoing and other objects will become more readily apparent by referring to the following detailed description and the appended drawings in which:

FIG. 1 is a pictorial representation of the vial, stopper, release materials and preservatives.

FIG. 2 is a pictorial representation of the vial, stopper, release materials and flower.

FIG. 3 is a pictorial representation of several flowers with vials in a tray.

FIG. 4 is a side view of the apparatus showing the tray, conveyor, ozone hood and modified atmosphere packaging machine.

FIG. 5 is a cross sectional view of the modified atmosphere packaging machine.

FIG. 6 is a cross sectional view of the packaging section of the modified atmosphere packaging machine.

DETAILED DESCRIPTION

Figure 7:
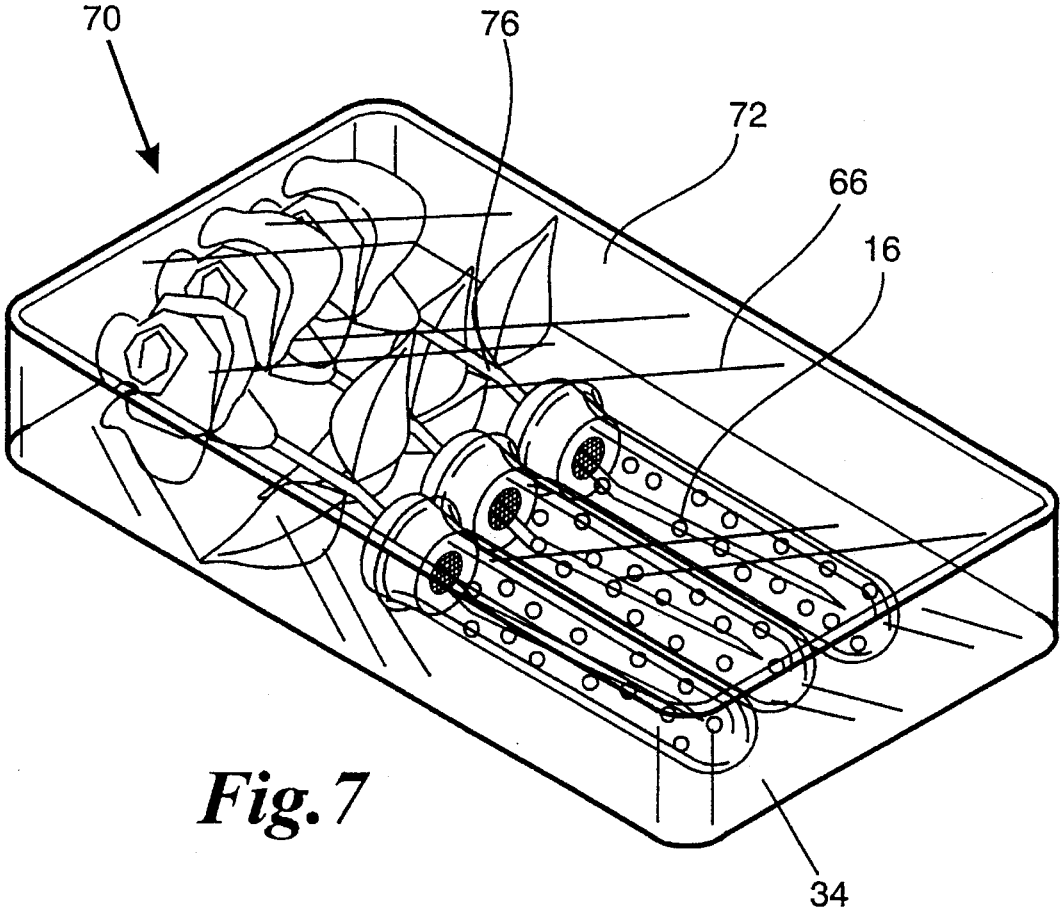
FIG. 7 is an isometric view of several flowers with vials in a selected modified atmosphere package.

Referring now to the drawings, and particularly to FIG. 1, the present invention involves a process for packaging flowers so that they are preserved in a fresh state for an extended period. The process uses a modified atmosphere packaging (MAP) machine which seals the flower in a container under vacuum, and a vial 10 which is attached to the stem 12 of the flower 14 and which releases a solution of preservative/rehydration and aluminum and/or silver thiosulfate (STS), and optionally color enhancer materials 16 from an absorbent medium 18 so that these flow upwardly through the stem 12 and outwardly through the pores of the flower 14 and leaves.

The first step of the invented process is the addition of liquid preservative and rehydration materials 16, FIG. 1, (these are compounds already known in the industry) to an absorbent material 18 to form a damp mass which is enclosed in the vial 10. The liquid preservative can be a sugar solution whereas the rehydrator can be citric acid. The absorbent material is important in that it provides a "timed release" of the liquid materials 16. This absorbent material 18 is a paper industry waste product which contains cellulosic fibers which expand or "come apart" under vacuum, slowly releasing the liquid. The vial 10 is sealed with a stopper 20 having a thin, penetrable membrane 22. Both the vial 10 and stopper 20 hardware are commonly available in the industry.

The second step of the process is submerging 24, FIG. 2, the sealed vial 26 in water 28. The stem 12 of the flower 14 is cut, preferably under water 28 and then inserted through the pierceable membrane 22 of the submerged vial 26 and into the mass of absorbent material 30. As this is done, the membrane 22 forms a tight seal about the stem 12 of the flower 14. The step of cutting the stem under water to avoid the introduction of air (a "bubble") into the stem capillaries is known in the art.

The third step of the process is assembling several of the flowers 14 and their associated vials 26 into a bouquet 32, FIG. 3, which is then placed in a plastic tray 34 to form package 36 for packaging. The plastic tray 34 is preferably a simple, vacuum formed piece much like those which are commonly seen in the pasta and meat sections of a supermarket. In fact, a MAP machine which is used to package meat, fish, and other products is basically similar to that which is used in the present invention, although it has been modified for the present process.

The fourth step of the process is placing the package 36, FIG. 4, on a conveyer 38 which leads into and through the MAP machine 40. It first passes through an ozone hood 42 which serves to sterilize the flowers against microorganisms. From here, the package moves to the interior of the MAP machine itself.

The fifth step of the process is conveying the package 36 to the vacuum chamber 44, FIG. 5, of the MAP machine 40, which is maintained at a vacuum within a range which is suitable for the type of flower being packaged. In the case of roses, about 3.5 inches Hg is suitable. As the air is evacuated from the chamber 46 through orifice 48, small amounts of nitrogen ($N_2$) 50, helium (He) 52, and argon (Ar) 54 are introduced into the chamber through orifices 56, 58, and 60 respectively. The accurate control of the gas environment 62 produces superior results. These gases, nitrogen, helium and Argon are blended into the chamber 44 while maintaining the vacuum. The $N_2$ 50 serves to stabilize the flowers against decay, while the He/Ar mixture serves to intensify their coloration. While there is some knowledge in the industry that these gases can help enhance the characteristics of the flower (and the use of $N_2$ itself is well known in MAP packaging), I have developed some proprietary ratios which are specifically adapted to particular varieties of flowers.

The sixth step of the process is conveying the tray containing the flowers 46 from the vacuum chamber through the packaging section 64 of the MAP machine 40. Note that these sections, vacuum chamber 44 and packaging section 64, may be continuous. The packaging section 64 is maintained under vacuum and with the same $N_2$/He/Ar atmosphere 62. A plastic seal 66 is pressed onto the tray 34 by a die 68. This part of the process, apart from the mixture of gases, is generally conventional in MAP machines. Following this, the sealed package 70 continues on the conveyer and exits the packaging section 64.

The seventh step is the storage of the sealed package 70, FIG. 7. The plastic seal 66 maintains the vacuum 72 inside the package. The $N_2$ atmosphere 74 continues to stabilize the plant against deterioration, and the He/Ar mixture 74 continues to intensify the colors of the flowers. At the same time, the vacuum 72 "pulls" the liquid preservative and rehydrator 16 up through the stems and out through the pores of the flowers 76 as the liquid is released in a controlled manner from the cellulosic fibers of the absorbent material 18.

As noted above, the invention uses a cellulosic material to achieve a controlled release 76 of the liquid preservative/rehydrator and aluminum and/or silver thiosulfate (STS), and optionally color enhancers (such as carotene) 16 under vacuum 72 so that these are drawn upwardly through the flower while it is being stored in the packaging 70 and also the long term presence of the He/Ar mixture in the packaging to enhance the coloration of the flowers.

ALTERNATIVE EMBODIMENTS

While the present invention relates to a process for packaging roses, other flowers or other "botanicals" (e.g., cedar fronds) can also be preserved in a fresh state for an extended period.

While the process describes packaging of multiple flowers one skilled in the art would know that single flowers as well as bouquets of the same type of flower or multiple types of flowers can also be packaged using this process.

The vacuum chamber in most cases will be kept between 3½ to 10½ inches of mercury. A vacuum below 3½ inches of mercury does not allow for a good seal. Vacuums above 10½ inches of mercury tend to destroy the cellular structure of the flower or plant. In the case of roses the maximum vacuum is about 4½ to 5 inches of mercury. Cedar ferns can withstand vacuums of up to 10½ inches of mercury.

The pH of the liquid packed with the flowers is important to their extended preservation. Additives to the vial should be in the pH range 0.0 to 6.0.

Figure 8:
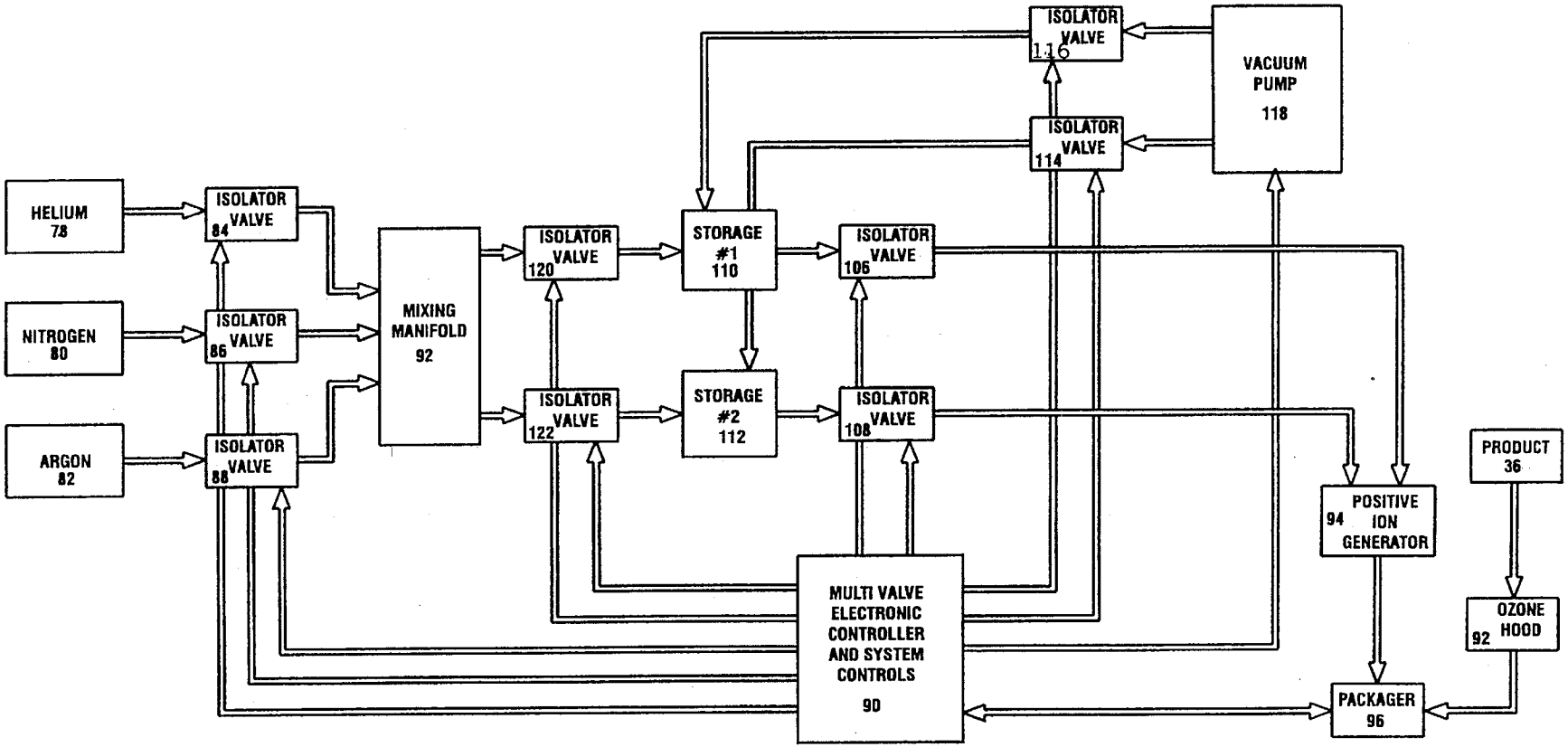
FIG. 8 is a block diagram of the process steps for preserving fresh flowers in accordance with the invention.

A proper blend of nitrogen, helium and argon which are ion balanced is optimal, it is noted that one could achieve good results by using just nitrogen, or a mixture of nitrogen and helium or nitrogen and argon. In the preferred embodiment one can achieve the proper blend of nitrogen, helium and argon by providing a blended gas control apparatus block diagrammed in FIG. 8. This apparatus consists of a helium tank 78, a nitrogen tank 80 and an argon tank 82 which are discretely connected to a helium isolator valve 84, a nitrogen isolator valve 86 and a argon isolator valve 88. Each isolator valve is connected to a multi-valve electronic controller and system controls 90 which regulates the flow of gas from each separate tank. Gases from each tank flow through their respective isolator valves into a mixing or blending manifold 92. The gases are combined in the mixing manifold 92.

After the gases are blended in the mixing manifold 92 then they are sent to one of two storage tanks 110, 112 through isolator valves 120 and 122. Isolator valves 120, 122 are regulated by the multi-valve electronic controller and system controls 90. Before any gases can be introduced into one of the two storage tanks 110, 112, the storage tanks must first be evacuated of any air. Vacuum pump 118 is connected to two isolated valves 116, 114 which are connected to the multi-valve electronic controller and system controls 90. Vacuum pump 118 is also operably associated with the multi-valve electronic controller 90. Storage tanks 110, 112 are in communication with isolator valves 106, 108 which are in communication with a positive ion generator 94 to balance the ions of the gases. The positive ion generator then sends processed gas to the MAP machine.

Figure 9:
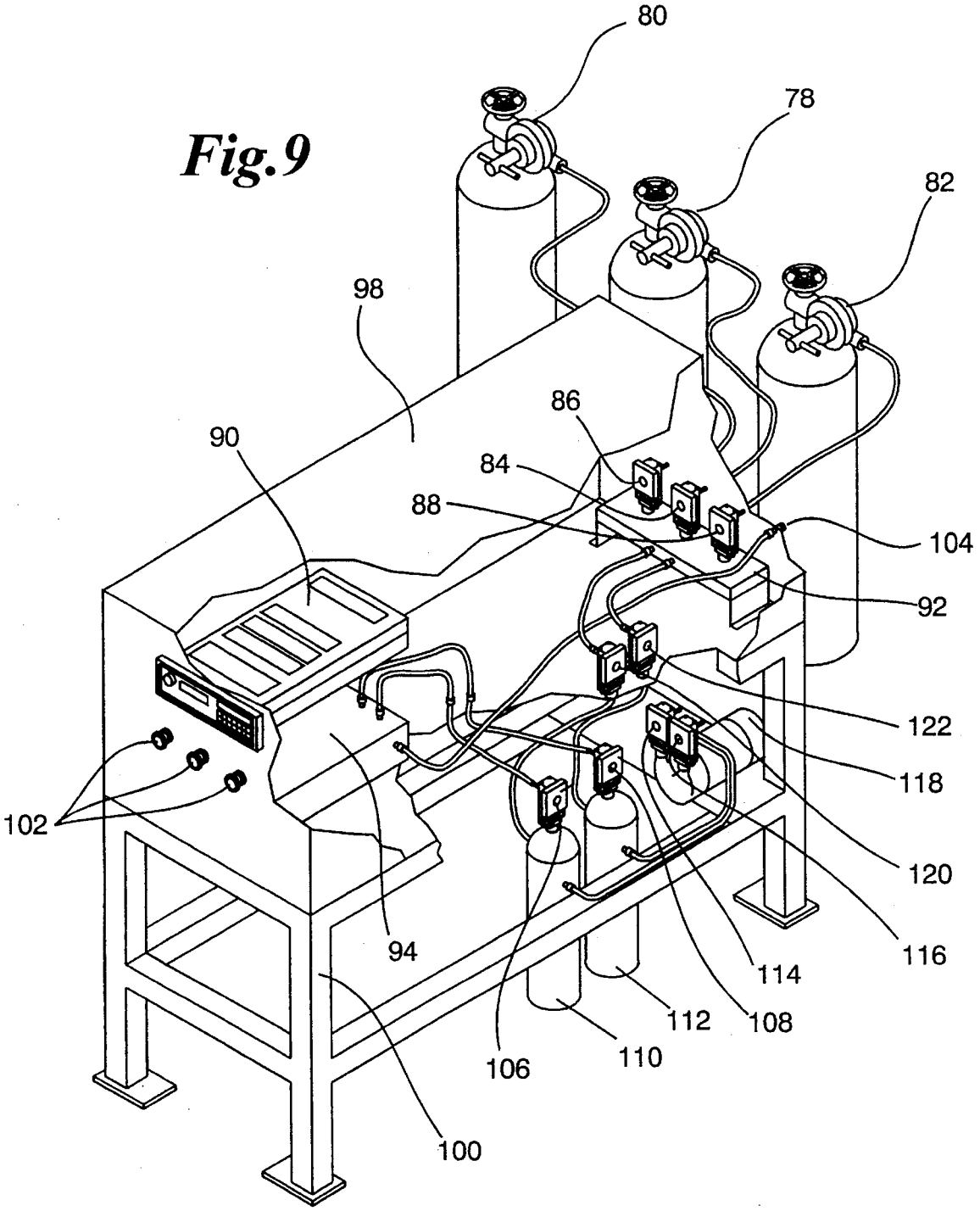
FIG. 9 is an isometric view of the apparatus for the controlled delivery of gases to the modified atmosphere packaging machine.

The multi-valve electronic controller 90, the helium isolator valve 84, the nitrogen isolator valve 86, the argon isolator valve 88, the blending manifold 92, the positive ion generator 94, the two storage tanks 110, 112, and isolator valves 106, 108, 120, 122, 114, 116 and vacuum pump 118 can all be housed in a stainless steel cabinet 98, FIG. 9. This cabinet 98 can be mounted on a stainless steel frame 100 and is configured with controller switches 102 which are operably connected directly to the multi-valve electronic controller 90. Cabinet 98 is configured with a blended gas output port 104. When this apparatus is used it will be readily apparent that the blended gas will be introduced into the vacuum chamber 44 through a single orifice (their would only be a single intake orifice for blended gas). It is also possible to split the blended gas and have it enter both the vacuum chamber 44 and the packaging section 64.

In operation, the multi-valve electronic controller 90 opens one of the isolator vales 114, 116 and engages the vacuum pump 118 to evacuate one of the two storage tanks 110, 112. The multi-valve electronic controller 90 then closes that valve and opens one of the two isolator valves 120, 122 which allows the blended gas from mixing manifold 92 to flow into the selected storage tank. Once the storage tank is filled with blended gas the multi-valve electronic controller 90 closes off that tank and it is available to supply the proper gas mixture to the MAP machine while the electronic controller 90 regenerates the other tank. When used in this fashion, one charger tank will always be available while the system recharges the second tank.

SUMMARY OF THE ACHIEVEMENT OF THE OBJECTS OF THE INVENTION

From the foregoing, it is readily apparent that we have invented an improved method and apparatus for packaging fresh cut flowers so that they are preserved in a fresh state for an extended period. This invention provides apparatus which packages fresh cut flowers in a modified atmosphere which result in a shelf life for these fresh flowers for an extended period of time.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. A method of preserving fresh cut flowers, comprising the steps of:

providing a sealed vial containing a preservative and having a top with a pierceable membrane;

submerging said sealed vial in water;

submerging a flower with a stem in water and cutting said stem under water resulting in a cut flower;

inserting submerged said cut flower through said pierceable membrane of submerged said sealed vial and into said preservative;

placing said cut flower and vial in a plastic tray;

evacuating air from said tray;

adding small amounts of gas into said tray while maintaining a vacuum;

providing a sheet of plastic and a die;

sealing said tray by placing said sheet of plastic over said tray; and applying pressure on said sheet of plastic and said tray with the die;

whereby said cut flower is enclosed in said tray having a gas atmosphere and sealed with said sheet of plastic.

2. A method according to claim 1 further comprising providing an absorbent material in said vial.

3. A method according to claim 1 further comprising providing rehydration material in said vial.

4. A method according to claim 1 further comprising providing silver thiosulfate (STS) in said vial.

5. A method according to claim 1 further comprising the step of passing said tray through an ozone hood before sealing said tray whereby said ozone hood serves to sterilize said cut flower against microorganisms.

6. A method according to claim 1 wherein the gases are selected from the group comprising nitrogen ($N_2$), helium (He), and argon (Ar) and any combination thereof.

7. A method according to claim 1 wherein the vacuum is from 3.5 inches of mercury to 10.5 inches of mercury.

8. A method according to claim 1 wherein the absorbent material pH is in the range of 0.0 to 6.0.

* * * * *